United States Patent [19]

Wright

[11] 4,243,360

[45] Jan. 6, 1981

[54] CANTILEVERED STRUCTURES

[75] Inventor: William B. Wright, Kegworth near Derby, England

[73] Assignee: Rolls-Royce Limited, London, England

[21] Appl. No.: 43,421

[22] Filed: May 29, 1979

[30] Foreign Application Priority Data

Jul. 25, 1978 [GB] United Kingdom ..... 31023/78

[51] Int. Cl.[3] ..... F01D 5/22

[52] U.S. Cl. ..... 416/191; 416/196 R

[58] Field of Search ..... 416/190, 191, 196 R

[56] References Cited

U.S. PATENT DOCUMENTS

| | | | |
|---|---|---|---|
| 1,618,292 | 2/1927 | Meissner | 416/196 |
| 2,772,854 | 12/1956 | Anxionnaz | 416/190 |
| 3,107,897 | 10/1963 | Varadi et al. | 416/191 |
| 3,545,882 | 12/1970 | Williamson | 416/190 |
| 3,771,922 | 11/1973 | Tracy | 416/190 X |

*Primary Examiner*—Everette A. Powell, Jr.

*Attorney, Agent, or Firm*—Cushman, Darby & Cushman

[57] ABSTRACT

A cantilevered structure comprises two cantilevers of unequal length adapted to span a gap (L) and overlap at their free ends so that load transfer may take place from the longer to the shorter cantilever. The cantilevers have the same Youngs Modulus, cross-sectional shape and same load per unit length applied to them, and the line of action of the load transfer between the cantilevers is up to 34% of the distance (L) between their encastres. The sum of the leading moments at the encastres of such cantilevers is lower than is the case with overlapping cantilevers where the line of action of load transfer between them is more than 34% of the distance between their encastres.

4 Claims, 3 Drawing Figures

CANTILEVERED STRUCTURES

This invention relates to cantilevered structures and in particular to structures where a gap is spanned by two cantilevers, one each side of the gap and meeting at their free ends.

BACKGROUND OF THE INVENTION

It is well known to span a gap be providing a cantilever on each side of the gap, the cantilevers being of equal length and meeting at their free ends. It is inevitable that when a load is applied to the cantilevers, the stresses at their encastres will increase. Consequently if high loadings are to be expected, the encastres must be of substantial construction in order to withstand the resultant stresses imposed upon them. However, such substantial constructions may impose undesirable weight penalties on the structure involved.

A typical situation where these conditions occur is in an axial flow gas turbine engine having shrouded aerofoil blades. Each such aerofoil blade is provided with a shroud at its radially outer end (in relation to the axis of rotation of the gas turbine engine) so that the shrouds of adjacent aerofoil blades cooperate to define a duct which contains the gases passing in operation over the aerofoil sections of the blades. The shrouds are only supported by their respective aerofoil sections and therefore constitute centilevers. The loads imposed upon the shrouds by the gases are high and consequently their positions of attachment to their respective aerofoil sections must be strong enough to withstand the resultant stresses. However, structure providing such strength usually results in an undesirable weight increase in the shrouded aerofoil blade.

BRIEF SUMMARY OF THE INVENTION

It is an object of the present invention to provide a cantilevered structure in which a gap is spanned by two cantilevers, one each side of the gap, wherein the sum of the bending moments at the encastres of the centilevers is reduced.

According to the present invention, a cantilevered structure comprises two cantilevers adapted to span the gap between the encastres of said cantilevers, the arrangement of said structure being such that when said cantilevers are loaded one cantilever is partially supported by the other so that load transfer takes place between them, the lengths of said cantilevers being arranged such that the line of action of said load transfer is so positioned that the sum of the bending moments at the encastres of said cantilevers is lower than would be the case if no load transfer occurred between said loaded cantilevers.

If said cantilevers have the same Youngs Modulus, the same cross-sectional shape and the same load per unit length applied to them, the distance between the line of action of the load transfer between said cantilevers and the encastre of the cantilever partially supporting the other cantilever is up preferably to 34% of the distance between the encastres of said cantilevers.

The distance between line of action of the load transfer between said cantilevers and the encastre of the cantilever partially supporting the other cantilever which cantilevers are of the same Young Modulus, the same cross-sectional shape and have the same load per unit length applied to them is preferably 21% of the distance between said encastres of said cantilevers.

Said cantilevers are preferably arranged so as to partially overlap whereby one cantilever is partially supported by the other so that load transfer takes place between said cantilevers.

According to a further aspect of the present invention a stage of aerofoil blades suitable for a gas turbine engine comprises an annular array of aerofoil blades, each aerofoil blade being provided at its radially outer end (with respect to the axis of said annular array) with a shroud having circumferentially extending portions, the adjacent circumferentially extending portions of the shrouds of adjacent aerofoil blades being so arranged that one shroud portion is partially supported by the other so that under engine operating conditions load transfer takes place between said adjacent shroud portions, the circumferential lengths of said shroud portions being arranged such that the line of action of said load transfer is so positioned that the sum of the bending moments at the positions of attachment of said shroud portions to their respective aerofoil blades is lower than would be the case if no load transfer occurred between said loaded shroud portions.

If said adjacent circumferentially extending shroud portions have the same Youngs Modulus, the same cross-sectional shape and have the same load per unit length applied to them, the distance between the line of action of the load transfer between said shroud portions and the position of attachment to its respective aerofoil blade of the shroud portion partially supporting its adjacent shroud portion is preferably up to 34% of the distance between the positions of attachment of said adjacent shroud portions to their respective aerofoil blades.

The distance between the line of action of the load transfer between said adjacent shroud portions and the position of attachment to its respective aerofoil blade of the shroud portion supporting its adjacent shroud portion of the same Youngs Modulus, the same cross-sectional shape and having the same load per unit length applied to them is preferably 21% of the distance between said positions of attachment of said shroud portions to their respective adjacent aerofoil blades.

Said adjacent shroud portions are preferably arranged so as to partially overlap whereby under engine operating conditions, one shroud portion is partially supported by the other so that load transfer takes place between said shroud portions.

DETAILED DESCRIPTION OF THE DRAWINGS

Figure 1:
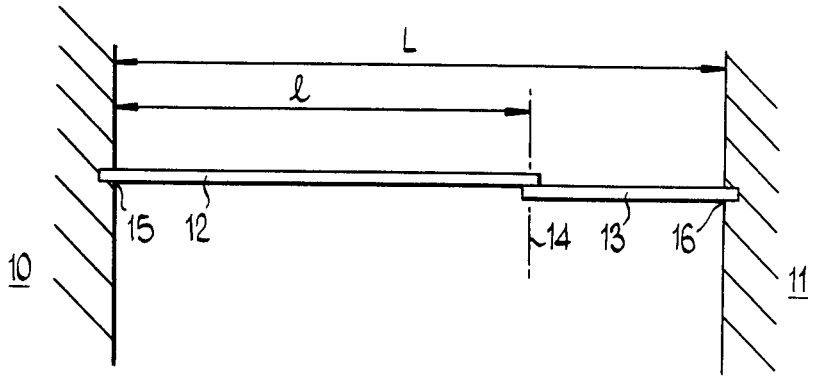
Figure 3:
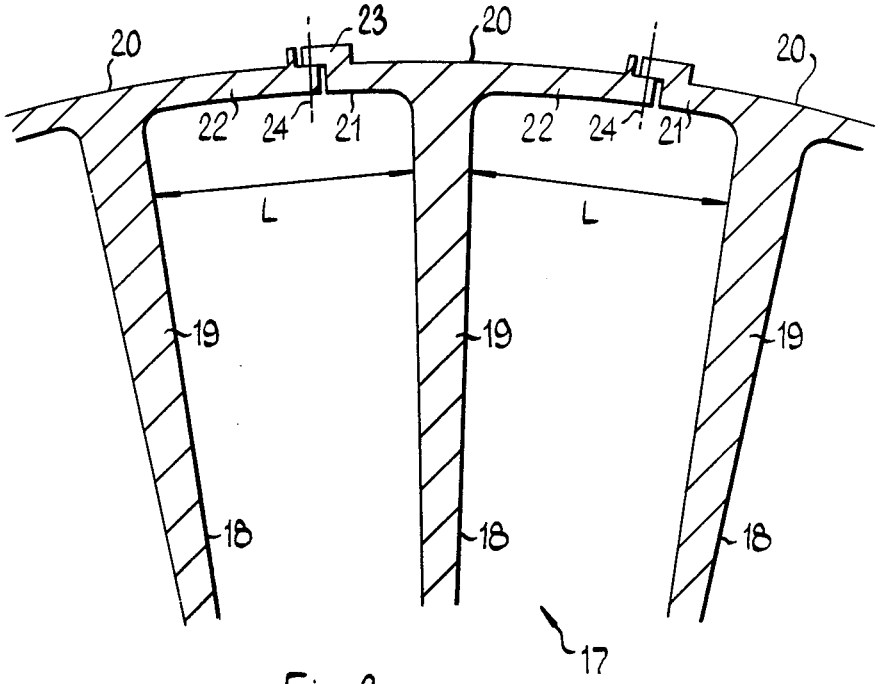
Figure 2:
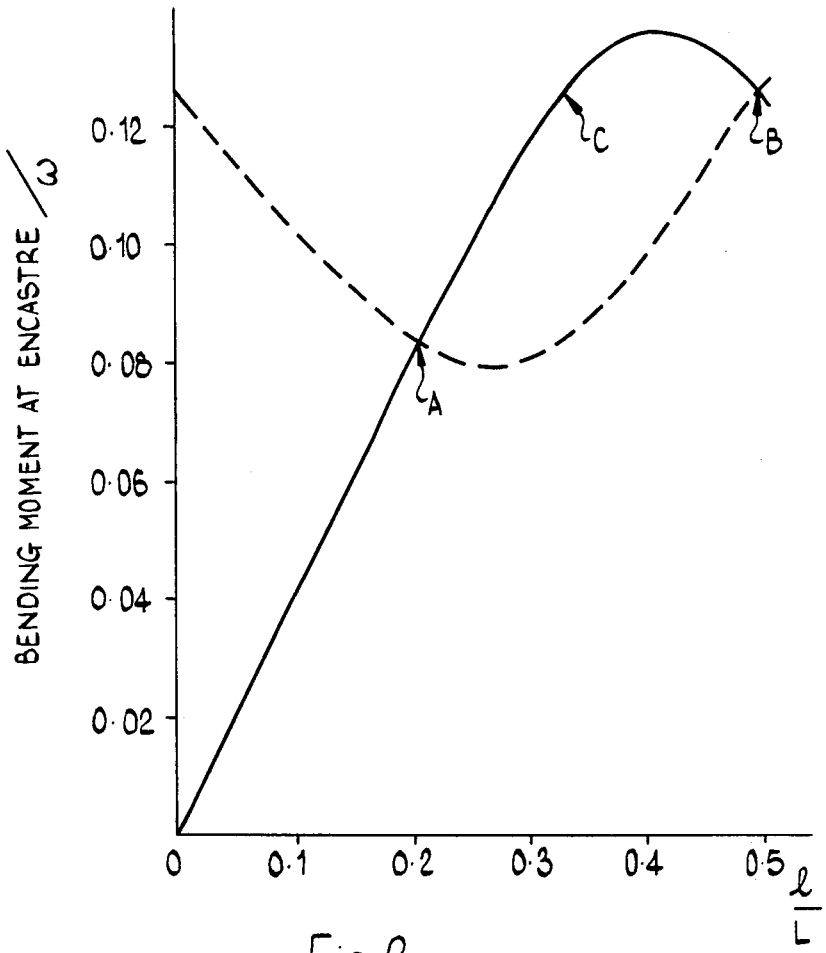

The invention will now be described by way of example, with reference to the accompanying drawings in which:

FIG. 1 is a front view of a cantilevered structure in accordance with the present invention, FIG. 2 is a graph indicating the bending moments at the encastres of cantilevers of differing lengths adapted to span a gap which cantilevers are arranged such that the longer cantilever is partially supported by the shorter, FIG. 3 is a sectioned front view of a portion of an annular array of shrouded aerofoil blades in accordance with the present invention.

DETAILED DESCRIPTION OF THE INVENTION

With reference to FIG. 1, the gap L between two fixed structures 10 and 11 is spanned by two cantilevers 12 and 13 having the same Youngs Modulus and cross-sectional shape. The cantilever 12 is attached to the fixed structure 10 whilst the cantilever 13 is attached to the fixed structure 11. The cantilever 12 is longer than the cantilever 13 and is also adapted to partially overlap it so that the longer cantilever 12 is partially supported by the shorter cantilever 12. There is consequently a load transfer of W weight units from the longer cantilever 12 to the shorter cantilever 13. The line of action of the load transfer W is designated 14 in FIG. 1 and is a distance 1 from the fixed structure 10 (and consequently a distance (L−1) from the fixed structure 11). Each of the cantilevers 12 and 13 is provided with a uniformly distributed load of w weight units per unit length.

Now the deflection δ at the free end of a cantilever having a load W at that extremity is:

$$WS^3/3EI$$

where S=the free length of the cantilever and E=Youngs Modulus. I=moment of inertia.

Similarly the deflection δ at the free end of a cantilever having a uniformly distributed load w is $$wS^4/8EI$$

where again S=the free length of the cantilever and E=Youngs Modulus I=moment of inertia Considering the longer cantilever 12 ($1>\frac{1}{2}L$)

$$=\frac{wl^4}{8EI}-\frac{Wl^3}{3EI}$$

and similarly for the shorter cantilever 13 ($(L-1)<\frac{1}{2}L$)

$$=\frac{w(L-l)^4}{8EI}+\frac{W(L-l)^3}{3EI}$$

Since the longer cantilever 12 is partially supported by the shorter cantilever 13 then δ is common to both cantilevers. Consequently:

$$\frac{wl^4}{8EI}-\frac{wl^3}{3EI}=\frac{w(L-l)^4}{8EI}+\frac{W(L-l)^3}{3EI}$$

$$3wl^4-8Wl^3=3w(L-l)^4+8W(L-l)^3$$

$$8W((L-l)^3+l^3)=3w(l^4-(L-l)^4)$$

Hence W=

$$\frac{3}{8}w\left[\frac{l^4-(L-l)^4}{(L-l)^3+l^3}\right] \quad (1)$$

Now the bending moment at the encastre 15 of the longer beam 12 is:

$$(Wl^2/2)-Wl$$

Consequently from equation (1), that bending moment is:

$$\frac{wl^2}{2}-\frac{3}{8}wl\left[\frac{l^4-(L-l)^4}{l^3+(L-l)^3}\right] \quad (2)$$

Similarly the bending moment at the encastre 16 of the shorter beam 13 is:

$$\frac{w(L-l)^2}{2}+W(L-l)$$

Consequently from equation (1), that bending moment is:

$$\frac{w(L-l)^2}{2}+\frac{3}{8}w(L-l)\left[\frac{l^4-(L-l)^4}{l^3+(L-l)^3}\right] \quad (3)$$

The curves of each of the equations (2) and (3) can be seen in FIG. 2 which is a graph of bending moment at encastre divided by w versus 1 divided by L. The curve of equation (2), which is the bending moment at encastre 15 of the longer beam 12, is shown in solid line whilst the curve of equation (3), which is the bending moment at encastre 16 of the shorter beam 13 is shown in interrupted line.

The points of equal bending moment in the cantilevers 12 and 13 are indicated by the points at which the two curves in FIG. 2 cross i.e. at points A and B. Point B is at 1/L=0.5 which is mid way between the fixed structures 10 and 11. Point A however, is at 1/L=0.21. It is extremely important to note that at point A, the bending moments of the cantilevers 12 and 13 at their respective encastres are considerably lower than they are at point B. Moreover, it should be noted that for all values 1/L up to 0.34, the bending moments at their encastres both cantilevers 12 and 13 are lower than is the case when 1/L is 0.5 i.e. mid way between the fixed structures 10 and 11.

Summarising, therefore, for two cantilevers 12 and 13 of the same cross-sectional shape and Youngs Modulus but of unequal lengths to which the same load per unit length is applied which span a gap L and which are adapted such that the longer cantilever 12 is partially supported by the shorter cantilever 13, the sum of the bending moments of both cantilevers 12 and 13 at their encastres 15 and 16 respectively is lower than is the case when both cantilevers are of equal length if the distance (L−1) of the line of action 14 of the load transfer between the cantilevers and the encastre 16 of the shorter supporting cantilever 13 is up to 34% of the distance L between the fixed structures 10 and 11. More specifically their bending moments at their encastres 15 and 16 are at their lowest equal values when the distance between the line of action 14 of the load transfer between the cantilevers 12 and 13 and the encastre of the shorter supporting cantilever 13 is 21% of the distance L between the fixed structures 10 and 11.

One example of an application of the present invention is illustrated in FIG. 3. With reference to FIG. 3, there is shown part of an annular array of shrouded aerofoil blades 17 which are mounted within a gas turbine engine (not shown). Each aerofoil blade 18 comprises an aerofoil portion 19 on the radially outer end of which is mounted a shroud 20. Each shroud 20 comprises circumferentially extending portions 21 and 22 which are adapted to cooperate with the adjacent circumferentially extending shroud portions 21 and 22 of adjacent aerofoil blades 17.

The circumferentially extending shroud portion 21 is provided with a lip 23 adapted to engage the edge of the adjacent shroud portion 22 of the adjacent aerofoil blade 18. The arrangement is such that the pressure of the gases which during engine operation passes over the aerofoil portions 19 urges the edge of the shroud portion 22 into engagement with the lip 23. The shroud portion 21 is shorter than the shroud portion 22 so that the distance of line of action 24 of the load transfer from the shroud portion 22 to the shroud portion 21 from the position of attachment of the shroud portion 21 is 21% of the distance L between the positions of attachment of the shroud portions 22 and 21 to their respective aerofoil portions 19.

The arrangement thus benefits from the advantages of cantilevers of unequal lengths previously described and consequently the sum of the bending moments at the positions of attachment of the shroud portions 21 and 22 is lower than they would have been if the shroud portions 21 and 22 were of equal length. Stresses at the position of attachment of the shroud portions 21 and 22 are consequently lower.

A further advantage of the above shroud arrangement is that the overlapping of one shroud portion by its adjacent shroud portion provides a seal preventing undesirable leakage of the gases passing in operation over the aerofoil portions 19.

Although the present invention has been described with reference to the shrouded aerofoil blades of a gas turbine engine, it will be appreciated that it is equally applicable to any suitable cantilevered structure.

I claim:

1. A cantilevered structure comprising:

a pair of spaced encastres;

a pair of cantilevers, one cantilever extending from one encastre and the other cantilever extending from the other encastre so that both cantilevers span a gap between said encastres, said cantilevers, when loaded, being arranged so that one cantilever is partially supported by the other cantilever and a load transfer takes place therebetween;

a Youngs Modulus, a cross-sectional shape and an applied load per unit length of one of said cantilevers being the same as a Youngs Modulus, a cross-sectional shape and an applied load per unit length respectively of the other of said cantilevers; and said load transfer between said cantilevers having a line of action spaced a distance from said encastre of said one cantilever partially supporting said other cantilever in the order of 21% of a distance between said spaced encastres of said cantilevers.

2. A cantilevered structure as claimed in claim 1 wherein said cantilevers partially overlap when one cantilever is partially supported by the other cantilever and the load transfer takes place between said cantilevers.

3. A stage of aerofoil blades for a gas turbine engine comprising:

an annular array of aerofoil blades extending about an axis;

a shroud provided adjacent radially outer ends of said annular array of aerofoil blades, said shroud including circumferentially extending shroud portions, each having an attachment to one of said blades, adjacent circumferentially extending shroud portions of adjacent aerofoil blades under engine operating conditions being arranged so that one adjacent shroud portion is partially supported by the other adjacent shroud portion and a load transfer takes place between said adjacent shroud portions;

a Youngs Modulus, a cross-sectional shape and an applied load per unit length of one adjacent shroud portion being the same as a Youngs Modulus, a cross-sectional shape and an applied load per unit length respectively of the other adjacent shroud portion; and said load transfer between said adjacent shroud portions having a line of action spaced a distance from a position of said attachment of the other adjacent shroud portion to its respective aerofoil blade supporting the one adjacent shroud portion in the order of 21% of the distance between positions of attachment of said adjacent shroud portions to their respective adjacent aerofoil blades.

4. A stage of aerofoil blades as claimed in claim 3 wherein said adjacent shroud portions partially overlap under engine operating conditions, and the one adjacent shroud portion is partially supported by the other adjacent shroud portion and said load transfer takes place therebetween.

* * * * *